United States Patent [19]

Howles et al.

[11] 4,001,623

[45] Jan. 4, 1977

[54] ARC TUBE FOR HIGH-PRESSURE MERCURY/METAL HALIDE LAMP

[75] Inventors: Donald Arthur Howles; Robert Brian Page, both of London, England

[73] Assignee: Thorn Electrical Industries Limited, London, England

[22] Filed: Mar. 18, 1975

[21] Appl. No.: 559,536

[30] Foreign Application Priority Data

Mar. 20, 1974 United Kingdom ..... 12410/74

[52] U.S. Cl. ..... 313/184; 313/217; 313/220; 313/229

[51] Int. Cl.[2] ..... H01J 61/068; H01J 61/20; H01J 61/30

[58] Field of Search ..... 313/184, 217, 229, 220, 313/25

[56] References Cited

UNITED STATES PATENTS

| | | | |
|---|---|---|---|
| 2,830,210 | 4/1958 | Jenne, Jr. et al. | 313/25 |
| 2,845,557 | 7/1958 | Gottschalk | 313/25 |
| 2,888,585 | 5/1959 | Martt et al. | 313/25 |
| 3,093,769 | 6/1963 | Kuhl et al. | 313/25 X |
| 3,614,508 | 10/1971 | Ito et al. | 313/229 X |
| 3,798,487 | 3/1974 | Zollweg et al. | 313/184 X |
| 3,858,078 | 12/1974 | Koury | 313/25 X |
| 3,896,326 | 7/1975 | Fohl | 313/220 |

*Primary Examiner*—Palmer C. Demeo
*Attorney, Agent, or Firm*—Robert F. O'Connell

[57] ABSTRACT

A high-pressure mercury/metal-halide discharge lamp has the discharge electrodes offset below the central axis of the arc tube to increase the uniformity of the wall temperature and improve the performance of the lamp. The upper part of the arc tube wall is shaped to be nearer the electrodes at the ends and further from them at the center than in a cylindrical tube.

5 Claims, 7 Drawing Figures

ARC TUBE FOR HIGH-PRESSURE MERCURY/METAL HALIDE LAMP

The present invention relates to high-pressure mercury/metal halide lamps.

It is known that the addition of metal halides to mercury vapour discharge lamps modifies the nature of the emission from the lamp in a useful way, but the resulting lamps are generally inferior to lamps containing mercury alone in respect of colour uniformity and maintenance of light output and colour during life.

In such lamps the arc tube has to be made of quartz (fused silica) or similar refractory material such as high-silica glass in order to withstand the high operating temperatures and the arc tube is enclosed in an outer glass envelope which in some cases has an internal coating of a fluorescent phosphor in order to further modify the emission from the discharge.

The present invention concerns the positioning of the electrodes and the shaping of the bulb of the arc tube so that when the tube is operated in a horizontal position the temperature distribution over the wall of the bulb is made more uniform and is this way the performance of the lamp is improved.

In accordance with the present invention there is provided a high-pressure mercury/metal-halide discharge lamp having an arc tube comprising a bulb closed at each end by a press seal and containing discharge electrodes, the bulb having a wall which is symmetrical about a plane generally parallel to the press seals and has a part-cylindrical portion with a cylinder axis lying in the said plane, characterised in that the discharge electrodes are offset in the said plane to lie between the cylinder axis and the part-cylindrical wall portion.

Preferably the wall of the bulb of the arc tube departs from the shape of a cylindrical tube with hemispherical ends in such a manner that the parts of the wall at the ends of the bulb which lie on the opposite side of the cylinder axis to the electrodes are brought closer to the electrodes. It is further advantageous if the part of the bulb wall between the ends which lies on the opposite side of the cylinder axis to the electrodes is taken further away from the electrodes than it would be in a cylindrical bulb.

The arc tube is intended to operate in a horizontal position with the press seals lying in a vertical plane. Although the bulb is made non-cylindrical it remains symmetrical about longitudinal and transverse vertical planes.

Figure 1:
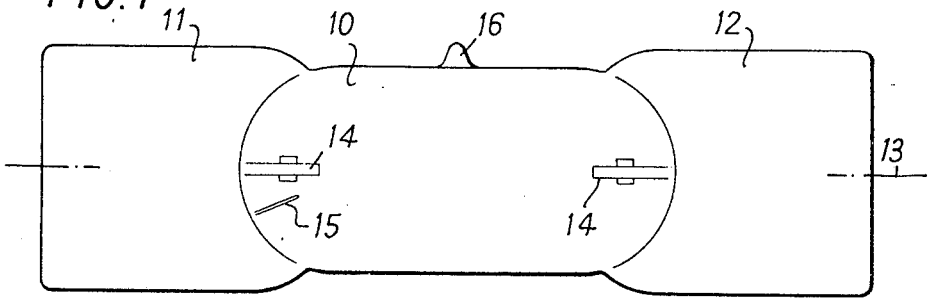
Figure 2:
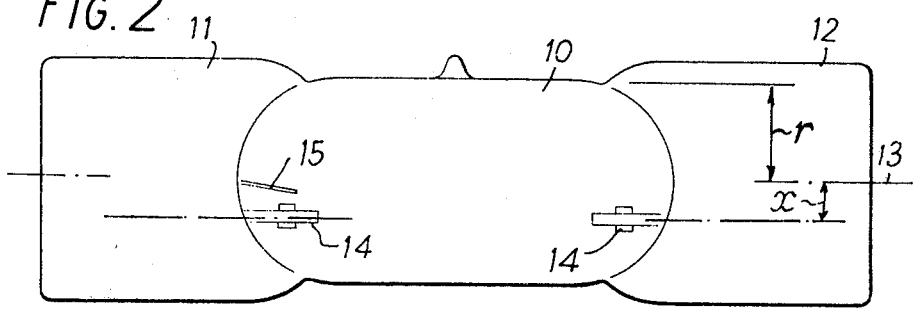
Figure 3:
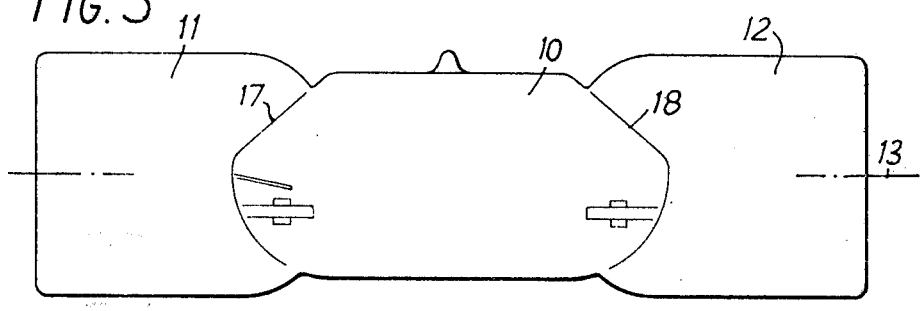
Figure 4:
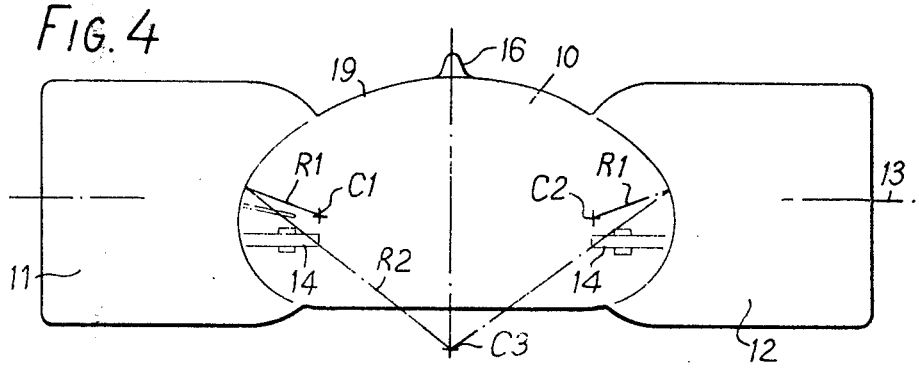
Figure 5:
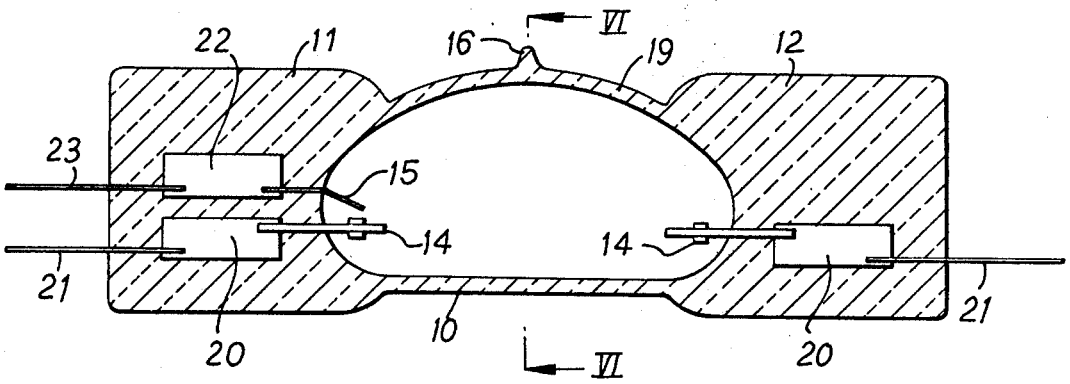
Figure 7:
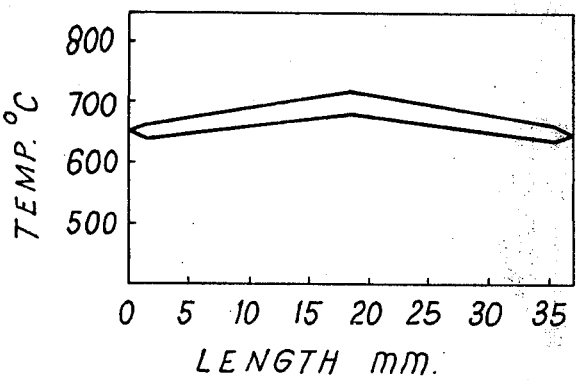
Figure 6:
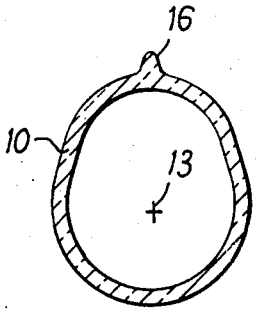

The invention will now be described in more detail with the aid of examples illustrated in the accompanying drawings, in which:

FIG. 1 is a side view of a conventional arc tube,

FIG. 2 is a side view of an arc tube with electrodes offset in accordance with the invention, FIGS. 3 and 4 are views similar to FIG. 2 showing modifications to the shape of the bulb, FIG. 5 is a longitudinal section of the arc tube of FIG. 4, FIG. 6 is a transverse section on the line V1—V1 of FIG. 5, and FIG. 7 is a graph of the temperature distribution over the surface of the bulb for the arc tube of FIGS. 5 and 6.

In FIG. 1 is shown a typical conventional arc tube of fused silica consisting of a cylindrical bulb 10 closed at its ends by press seals 11 and 12 which form generally hemi-spherical ends to the discharge space within the bulb. The tube is symmetrical about the cylinder axis 13. Within the discharge space two discharge electrodes 14 are positioned on the axis 13 at opposite ends of the bulb. A starting electrode 15 is positioned adjacent one of the discharge electrodes. The bulb 10 has an exhaust tip-off 16 formed by removal of an exhaust tube and sealing-off of the bulb during manufacture.

In FIG. 2 the arc tube of FIG. 1 has been modified by off-setting the discharge electrodes 14 by an amount $x$ below the cylinder axes 13. The arc tube is shown in the intended horizontal operating position with the press seals 11 and 12 lying in a generally vertical plane. Under these operating conditions the off-setting of the electrodes reduces the difference in temperature between the upper and lower surfaces of the bulb and thereby improves the lamp performance. The displacement $x$ of the electrodes with respect to the cylinder axis 13 can be between $r/5$ and $4r/5$ but is preferably $2r/5$, where $r$ is the internal radius of the cylindrical bulb 10. The starting electrode 15 has been transposed to a position approximately on the cylinder axis 13.

FIGS. 3 and 4 show modifications to the shape of the bulb 10 intended to achieve further improvements in the uniformity of the temperature distribution around the walls of the bulb. The lower half of the bub remains unchanged and the position of the cylinder axis 13 can always be determined by reference to this part-cylindrical surface. In FIG. 3 the upper half of the bulb is modified to bring the parts 17 and 18 of the bulb wall near the ends of the bulb closer to the electrodes 14. In the course of formation of the press seals 11 and 12 these parts 17 and 18 are flattened to give straight-line profiles. In FIG. 4 the upper half of the bulb is further modified by taking the central part around the exhaust tip-off 16 further away from the cylinder axis 13 and forming a continuously curved profile in the form of a catenary 19.

The sections of FIGS. 5 and 6 show the structure of the arc tube of FIG. 4 in more detail. Each of the discharge electrodes 14 is attached to the inner end of a molybdenum foil 20 whose outer end is attached to a lead-in conductor 21. The starting electrode 15 is similarly connected by a foil 22 to a lead 23. The foils 20 and 22 are embedded in the press seals 11 and 12 in conventional manner. As shown in FIG. 6 the transverse section of the bulb 10 at its centre is elongated from the basic circular shape to an oval or pear shape but the cylinder axis 13 remains at the centre of curvature of the semi-cylindrical lower half of the bulb.

In FIG. 7 the resulting temperature profile is shown for an arc tube having a bulb whose overall length is 37 mm. The maximum and minimum temperatures around the circumference of the tube are shown for each point along the length of the bulb. The highest wall temperature is at the centre of the bulb, mid-way between the electrodes. The temperature at the ends, in the region behind the electrodes should be 10° to 100° C, and preferably 20° to 50° C below the average temperature of the wall surface. It will be seen from FIG. 7 that the temperature at the ends is about 650° C, rising to just over 700° C (maximum) at the centre.

The dimensions of the arc tube shown in FIGS. 5 and 6 and for which wall temperatures are shown in FIG. 7 are as follows. The length of the discharge space is 34mm., the distance between the tips of the electrodes 23mm. The internal diameter of the tube before shaping is 14mm. The electrodes are fabricated from a pure tungsten shank 0.635 dia. carrying three turns of tungsten wire 0.584mm. in diameter and are offset by 3mm. below the longitudinal axis of the discharge tube. The shaping of the discharge tube in a vertical plane containing the cylinder axis is made up of four contours, two arcs of circles with radius R1 = 5.7mm. (see FIG. 4) from centres C1 and C2 1.7 mm. above each electrode tip, an arc of a circle of radius R2 = 22.7mm. struck from a point C3 on a line midway between the electrodes and perpendicular to the arc tube axis, such that this arc joins the upper extremities of the two previously-mentioned arcs; and a straight line which joins the lower extremities of these two arcs.

The fabricated discharge tube is processed by means known in the art and dosed with sodium iodide, scandium iodide, caesium iodide, mercury and argon so as to achieve approximate operating pressures of $5.0 \times 10^{-5}$ atmospheres of sodium iodide, $2.1 \times 10^{-5}$ atmospheres of caesium iodide, $2.5 \times 10^{-5}$ atmospheres of scandium iodide, 5.9 atmospheres of mercury and 40 Torr of argon. The discharge tube is located within a bulb which may be phosphor-coated and electrical connections are made to the cap. The bulb is filled with inert gas such as nitrogen to about 200 Torr. The characteristics of such a lamp are typically 250 watts, 90 volts. 3.1 amps., giving a luminous efficacy of 84 $lm.w^{-1}$ after 100 hour burning. After 1000 hours the efficacy has been found to be about 95% of the 100 hour value.

We claim:

1. In a high-pressure mercury/metal halide discharge lamp for operation in a horizontal position, said lamp having an arc tube comprising a bulb closed at each end by a press seal and containing discharge electrodes, the bulb having a wall which is symmetrical about a plane generally parallel to the press seals, the improvement wherein the bulb wall has a part-cylindrical portion having a cylinder axis lying in said plane, said portion being below said cylinder axis when the lamp is in its horizontal operating position, and said discharge electrodes are positioned in alignment with one another in said plane and offset in the same direction below said cylinder axis to lie between the cylinder axis and said part-cylindrical wall portion.

2. In a lamp as claimed in claim 1 the further improvement wherein said bulb wall has at each end a first end portion lying on one side of said cylinder axis and adjacent said part-cylindrical portion and a second end portion lying on the other side of said cylinder axis, said second end portion being closer to the electrode than an imaginary surface symmetrical with said first end portion.

3. In a lamp as claimed in claim 2 the further improvement wherein said bulb wall has a middle portion disposed opposite and part-cylindrical portion and further from the cylinder axis than said part-cylindrical portion.

4. In a lamp as claimed in claim 1, the further improvement wherein the said bulb wall has a profile in the said plane which comprises a straight line at the intersection of said part-cylindrical portion with said plane, two arcs of circles having centres above the tips of the discharge electrodes, and a third arc of larger radius joining the first two arcs, the centre of the third arc lying on a line midway between the electrodes.

5. In a lamp as claimed in claim 1, the further improvement wherein the offset of said discharge electrodes from the cylinder axis is between one-fifth and four-fifths of the radius of said part-cylindrical portion.

* * * * *